United States Patent [19]

De Dube

[11] 4,357,768

[45] Nov. 9, 1982

[54] DISPLAY CARD HOLDER

[76] Inventor: Brett De Dube, 6 Club Dr., Massapequa, N.Y. 11758

[21] Appl. No.: 241,115

[22] Filed: Mar. 6, 1981

[51] Int. Cl.[3] ..... G09F 3/18

[52] U.S. Cl. ..... 40/17

[58] Field of Search ..... 40/10, 16, 17, 373

[56] References Cited

U.S. PATENT DOCUMENTS

| | | | |
|---|---|---|---|
| 310,119 | 11/1963 | Reiner | 40/17 |
| 358,644 | 3/1887 | Brophy | 40/17 |
| 2,951,301 | 9/1960 | Slavsky | 40/17 |
| 3,314,548 | 4/1967 | Stewart | 40/16 R |
| 3,597,861 | 8/1971 | Gordon | 40/16 R |
| 3,769,725 | 11/1973 | Stewart | 40/10 R |
| 4,184,277 | 1/1980 | Larin | 40/16 R |

FOREIGN PATENT DOCUMENTS

| | | | |
|---|---|---|---|
| 180783 | 9/1962 | Sweden | 40/373 |

*Primary Examiner*—Gene Mancene
*Assistant Examiner*—Wenceslao J. Contreras
*Attorney, Agent, or Firm*—Arnold L. Albin

[57] ABSTRACT

An improved display card holder, adapted for use in bulletin boards, as in arrival and departure boards for airlines, characterized by a retaining channel, in a base member, adapted to slideably receive a linear display card element, and a latch lever arm with a head extending through an opening in the base, which head is resiliently mounted and abuts against and arrests lateral motion of the display card element, so as to detachably secure the display card in the retaining track. A feature of the invention is that the operative elements of the latch are concealed and secured from tampering. A further feature of the invention is that its separate elements may be assembled or removed from the holder without the use of hand tools or fasteners.

7 Claims, 8 Drawing Figures

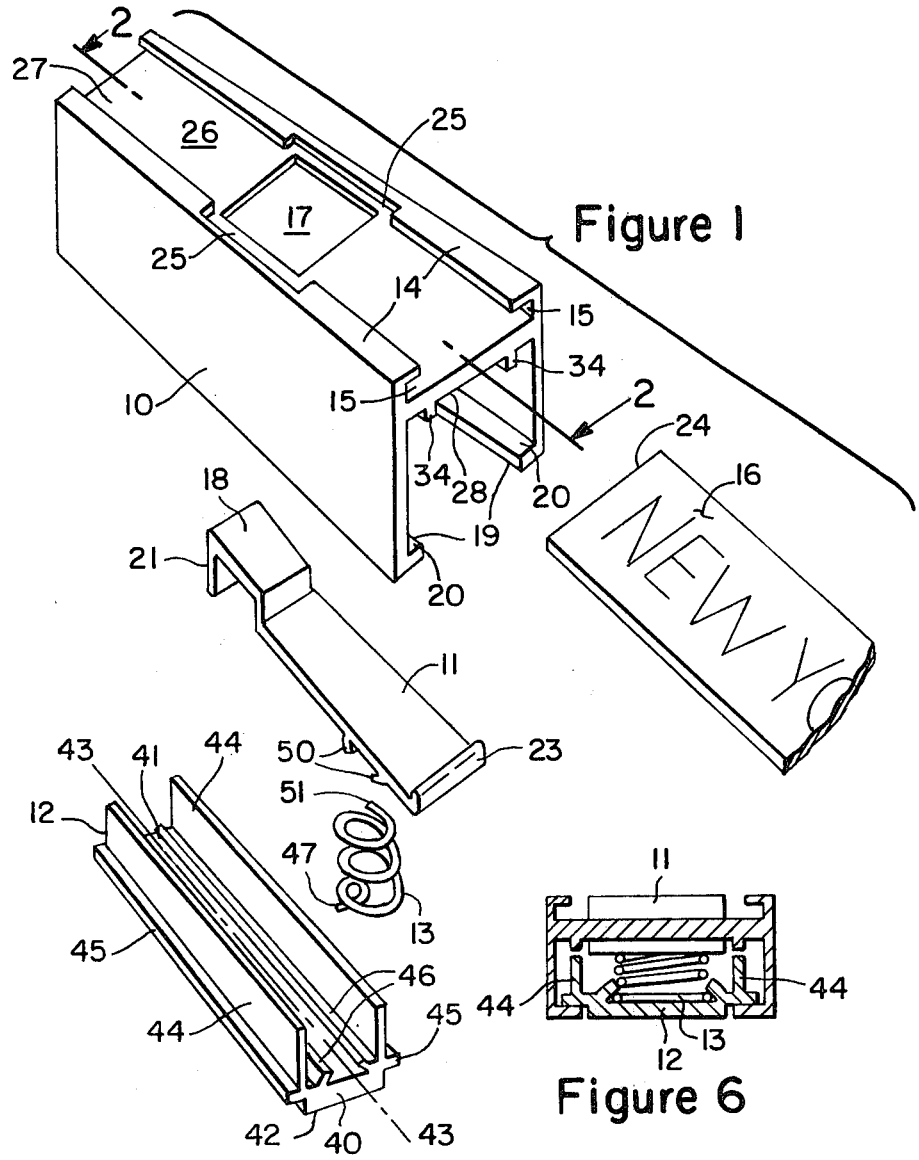
Figure 1
Figure 6
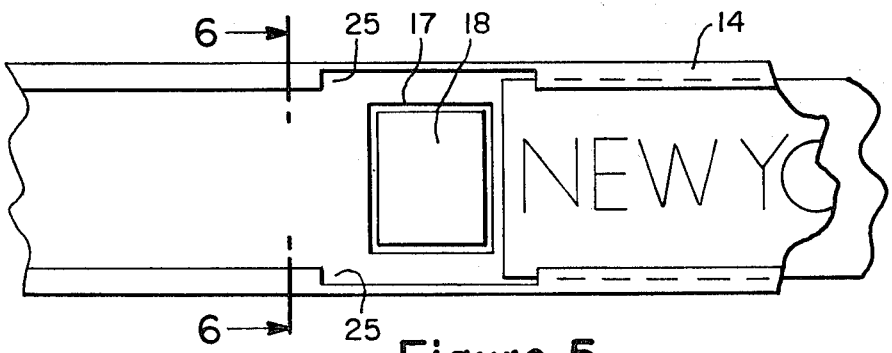
Figure 5

DISPLAY CARD HOLDER

BACKGROUND OF THE INVENTION

1. Field of the Invention

This invention relates to display card holders, and more particularly proposes the construction of a display card holder adapted for use in bulletin boards, as in arrival and departure boards for airlines, and characterized by a display card housing having a retaining track for receiving a linear printed, painted, embossed, or engraved display card element, a locking lever having a stop-face extending through an aperture in the base member, which head is resiliently mounted and abuts against and arrests lateral motion of the display card element, so as to detachably secure the display card in the retaining track. A feature of the invention is that its separate elements may be assembled or removed from the holder without the use of hand tools or fasteners.

Bulletin boards, display easels, and directional signs may use removable inserts to facilitate changing the sign message. Since such inserts must be readily installed and removed, they are subject to tampering and vandelism. Permanent mounting methods, such as screws, rivets, and adhesives defeat the feature of ready revision.

This invention is of a locking device which can be installed in a track for retaining sign elements, which is easily installed, latched or disengaged from the display carrier without tools, and which, in the latched position, will secure the sign elements from displacement.

2. Description of the Prior Art

The prior art display card holders have been used in such applications as a license plate holder, U.S. Pat. No. 1,573,443, issued to F. Haller, Feb. 16, 1926; check holders for mine cards, U.S. Pat. No. 1,953,707, issued to R. B. French, Apr. 3, 1934, and U.S. Pat. No. 1,628,525, issued May 10, 1927 to C. E. Bell; display card holder, U.S. Pat. No. 1,523,778, issued Sept. 15, 1931 to L. Bailey; and a picture frame for handbags, U.S. Pat. No. 2,302,560, issued Nov. 17, 1942 to S. Latora.

These prior art devices required special notching, cams, magnetic latches, or retention by friction or permanent or semi-permanent fasteners, such as clips, common screws, and rivets, which require tools for installation and removal, and are thus more costly and time-consuming to replace.

Further, while card holders with friction retained elements are subject to loss or disarrangement through upset or vandelism, permanent or semi-permanent fasteners impair the facility for replacement of individual sign card elements, particularly in a bulletin board array with a multiplicity of sign elements, as an airport flight schedule.

The advantages of the subject invention are that it provides a positive stop for securing sign elements, yet permits easy removal without tools, is simple in construction and can be assembled by hand without special tools, and facilitates removal of flexible sign card elements.

SUMMARY OF THE INVENTION

This invention has for its general object to provide an improved display card holder which retains a sign card element in place with a resiliently mounted latch, in combination with a retaining channel.

another object of this invention is to provide a construction which permits hand assembly of a display card holder's component elements without the need for tools.

Still another object of this invention is to provide an improved display card holder which is relatively simple to construct and assemble, and economical to produce.

A further object of this invention is to provide a display card holder which is adaptable to retention of multiple display card elements.

It is another object of this invention to provide a latch head for display card holders which is easily disengaged without tools for inserting or replacing sign card elements.

It is also an object of this invention to provide a latch head for display card holders which assists in ejecting sign card elements from a retaining channel.

These and other objectives are achieved through the use of a sign card base member having a web and an upper retaining channel, a hole in the web, a lower retaining channel for a carriage member slideably engaging the sign card base member, a latch lever arm pivotedly mounted between the base member and the carriage member, and a resilient element confined between the latch lever arm and the lever retaining channel, such that a head on the latch lever arm is resiliently urged to protrude through the hole in the web.

Further features and objects of the invention will be apparent from an examination of the accompanying drawings which illustrate the invention.

BRIEF DESCRIPTION OF THE DRAWINGS

Referring now to the figures, in which like reference characters refer to like elements in the separate views, FIG. 1 is an exploded view in perspective of a display card holder.

FIG. 5 is a plan view of a display card base member with sign card insert.

FIG. 6 is a transverse section through 6—6 of FIG. 5.

DESCRIPTION OF THE PREFERRED EMBODIMENT

Figure 2:
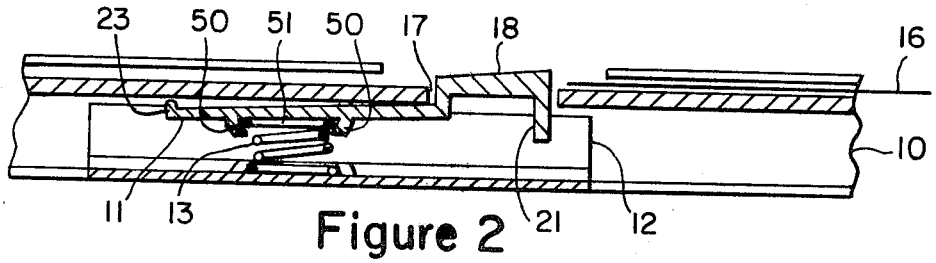
FIG. 2 is an assembled view in cross-section through 2—2 of FIG. 1.

FIG. 1 shows an exploded view of the subject invention, comprised of a base member 10 for the display card element 16, a latch lever arm 11, a carriage member 12, and resilient biasing means 13.

The display card base member has a pair of opposing flanges 14 defining an upper channel 15 for slideably receiving the display card element. A hole 17 in the body accepts the head 18 of the latch lever arm 11. The display card base member 10 has a further pair of flanges 19 defining a lower channel 20 for receiving carriage member 12. Secured to the locking lever at its underface is a resilient biasing means, such as a coil or leaf spring 13. The biasing means is further secured at its lower end to the carriage member 12.

Figure 3:
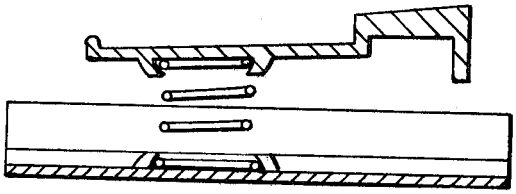
FIG. 3 is of a latch lever arm sub-assembly in its free state.
Figure 4:
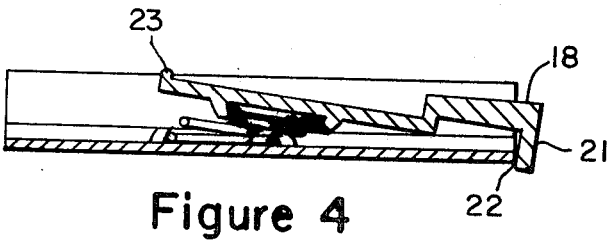
FIG. 4 is of a locking lever sub-assembly in its latched state.

As shown in FIG. 2, the latch lever arm 11, biasing means 13, and carriage member 12 form an assembly when inserted in the display card base member, such that the head 18 resiliently extends through the aperture 17. In order to assemble the slideable array, shown in FIG. 3 in the free or uncompressed state, into the base member, the latch lever arm is forceably displaced laterally against the resilient biasing means, and a lip 21 adjoining the head is thereby forceably latched onto the carriage member at its outer lateral edge 22, as shown in FIG. 4. By depressing the trailing lip 23 of the latch lever arm, the slideable array may be displaced into the body of the base member until the head 18 is aligned with the hole 17. By slightly depressing the carriage upwardly against the biasing means, lip 21 will be freed from its engagement with edge 22. The head 18 will be urged upwards through the hole 17, as shown in FIG. 2. A sign card element 16 previously inserted in the channel 15 will thereby be retained in position by the head 18 which extends above web 26 and abuts the sign card element 18.

Removal is accomplished by simultaneously depressing the latch lever arm 11 and offsetting the carriage member 12 thereby engaging the assembly in the latched mode, FIG. 4, permitting the latch assembly to be slideably removed.

To insert a replacement sign element after the latch assembly has been installed, one end of the sign is placed over the head 18 and track relief area 25, FIG. 5. As the head is manually depressed below the surface of web, 26, the sign element may be easily slid into place in the track. When the head is released, the restoring force of the resilient element 13 will raise the stop area above the base of the web, thus capturing the sign card element in the channel 15.

Figure 7:
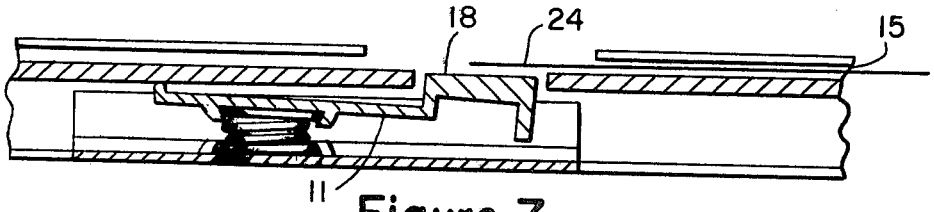
FIG. 7 is a section through 2—2 of FIG. 1, with sign card insert in unlatched mode.
Figure 8:
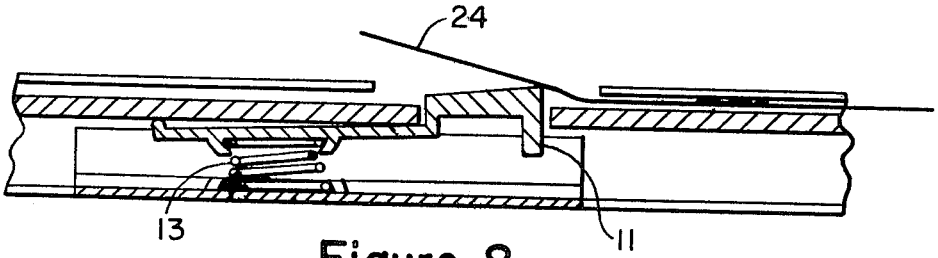
FIG. 8 is a section through 2—2 of FIG. 1, with sign card insert in ejection mode.

The resilient feature of the locking stop may also be used advantageously to assist in ejecting a sign card element. Since the element 16 is stiff and resides closely in the retaining channel 15, it is ordinarily difficult to grasp for removal of individual sign card elements in a series array. As shown in FIG. 7, by depressing the head 18 and simultaneously displacing the desired sign card element in the channel 15, its end 24 will overlap the head. As shown further in FIG. 8, when the latch lever arm 11 is released, the restoring force of the resilient member 13 behind the locking lever will raise the end 24 of the sign card element, thus permitting the fingers to easily grasp and remove the sign card element where the flanges 14 have been relieved for easy access at 25, as shown in FIG. 1.

In a preferred embodiment, as shown in FIG. 2, a sign card element 16, which may be printed, embossed, engraved, or painted, on a substrate of generally rigid material with some degree of longitudinal flexibility, such as cardboard or plastic laminate, is inserted in a display card housing 10. The insert 16 abuts a head 18 of the latch lever arm 11. The head 18 extends above the web 26 through an aperture 17 of generally rectangular configuration. A resilient means 13 is provided for urging the head 18 into an extended position with respect to the stationarily mounted base member. This means comprises a coil or leaf spring 13 confined between the latch lever arm 11 and the carriage member 12. It may be seen that the head acts to restrain any lateral displacement of the sign card insert 16.

The display card base member of FIG. 6 is comprised of a generally I-beam shaped cross-section, having a central web 26, which is generally linear in extent, with a width substantially greater than its thickness, defining an upper face 27 and a lower face 28. A pair of parallel side walls 29 depends longitudinally from opposing edges of the web 26, extending beyond the upper and lower faces 27 and 28. Flanges 14 and 19 depending from and at right angles to each sidewall 29 define an upper channel 15 and a lower channel 20. Extending from the lower face 28 of the web 26 is a pair of rails 84, parallel, raised and spaced apart and adjacent to the sidewalls 29.

The upper channel 15 is locally relieved by removal of a substantial portion of opposing adjacent flanges 14 at 25, bounding the hole 17.

Referring now to FIG. 1, carriage member 12 of generally U-shaped cross-section is provided with a planar base 40, an upper face 41, a lower face 42, and longitudinal axis 43. A first pair of flanges 44 extends parallel to the longitudinal axis of the slide and orthogonally from the upper face of the base 40.

A second pair of flanges 45 is recessed from the lower face 42 and extends laterally from the longitudinal axis 43 of the base 40. A pair of raised rails 46, spaced apart extends from the upper face 41 of the base 40. These rails are confined between flanges 44, and converge toward the centerline of the base on its longitudinal axis, as they extend outwardly. The resilient means 13 may be secured at its base by crimping the converging flanges 46 so as to secure the lower extremity 47 in permanent position.

As seen in FIG. 2, the latch lever arm 11 has a generally rectangularly shaped head 18 at one end, which is disposed to clear the hole 17. An orthogonal lip 21 extends from the head end of the lever. At the second end of the locking lever, an opposing lip 23 depends therefrom. The body of the lever is provided at its underface with a pair of "fish-tail" lugs 50 which may be crimped to secure the upper end 51 of the resilient means 13. The width of the latch lever arm 11 is chosen so as to permit displacement within the flanges 44 of carriage member 12, thereby enclosing the resilient means 13 between the latch lever arm and the carriage member, as shown in FIG. 6. It may be seen therefore, that the latch lever arm is adapted to compress the resilient means when it is inserted by sliding between the flanges on the lower face of the display card base member, and that the head will be resiliently engaged in the hole when the carriage member is longitudinally displaced along the base member so that the locking lever is disengaged from the carriage member.

The carriage member, locking lever, and display card base member are preferably made of metal, such as aluminum, and suitable sections may be selected from commercially available extrusions. The hole and areas of local flange relief may be machined by milling or grinding, as suitable to the materials selected. If it is desirable to use plastics, the elements of the invention as described may be molded, or machined from bar stock, using thermoplastic or other dimensionally stable materials. A rubber or resilient plastic plug may also be used for the biasing means.

The resilient biasing means is preferably formed from a steel coil spring of which a spring rate of 18 lb/in is suitable. A leaf spring may also be used. In one model, a coil spring was frictionally secured at the insert slide end by a crimp in the engaging flanges, and at the locking lever end by a "fish-tail" lug formed during the extrusion of the stock.

While a preferred embodiment has been set forth in the description and the drawings, it will be understood by those skilled in the art that design and structural details may be varied without departing from the true spirit and scope of the invention as defined by the appended claims.

What is claimed is:

1. A lockable display card holder, of the type adapted to receive an inserted card, comprising, in combination, a. an elongated base member, having upper channel means for slideably accepting a display card, a hole for accepting a latch head, the head adapted to retain the display card from lateral displacement, and lower channel means for slideably accepting a latch assembly, b. a latch assembly, comprising a concealed carriage member operatively associated in sliding relationship with the lower channel means, and defining a recess for accepting a latch lever arm, the arm having a head at one end in cooperative association with the base member hole, the head adapted to extend through the hole as a stop against the display card, and defining a lip depending therefrom and proportioned for interferring contact with the carriage member when in operative position, and for clearance therefrom when in transverse sliding non-operative position, the arm having a further lip at its opposite end in pivot relationship with the lower channel means, the arm being disposed between the carriage member and the base member in the cavity formed by the adjacent mating recess of the carriage member and the lower channel of the base member, c. resilient means located in the cavity, between the latch lever arm and the carriage member, such that the head is urged to extend through the hole to an operative position in locking relationship to the base member, the resilient means being affixed to both the latch lever arm and the carriage member.

2. The lockable display card holder of claim 1, wherein the base member is adapted to be fixed in place in a generally horizontal direction relative to a substantially vertical support surface, and having when so fixed two opposed side flanges forming the lower channel means and defining a substantially vertical rear face which is in abutting relationship with the support surface, and having means for vertically mounting the base member to the support surface so as to extend in a generally horizontal direction.

3. The lockable display card holder of claim 1, wherein a. the base member is further comprised of a generally I-beam shaped cross-section, having a central web which is generally linear in the longitudinal axis and a width substantially greater than the thickness, the web defining an upper face and a lower face, parallel opposing sidewalls extending beyond such upper and lower faces, opposing flanges depending from and at right angles to each of the sidewalls, defining the upper channel means and the lower channel means, the lower face further defining first and second rails, parallel, raised, spaced apart, and adapted for slideably receiving the carriage member, and where the hole is located in the web, substantially rectangular, bounded at the edges paralleling the longitudinal axis by the opposing sidewalls, and with the edges normal to the longitudinal axis adapted to accept the head of the latch lever arm, b. the carriage member is further comprised of a generally U-shaped cross-section, a generally planar base along the longitudinal axis, having an upper face, a lower face, a first pair of flanges extending parallel to the longitudinal axis and orthogonal to the upper face, a second pair of flanges recessed from the lower face and extending laterally from the longitudinal axis of the base, and a pair of raised rails, spaced apart and integral with the upper face and converging inwardly towards the longitudinal axis, c. the resilient means is comprised of a compression spring, d. the carriage member and latch lever arm are provided with frictional retaining means adapted to join to opposing ends of the compression spring, and e. the head of the latch lever arm is generally rectangularly shaped.

4. The latch lever arm as described in claim 3, provided with a body portion joining the head with the opposing lip at the pivot point, and having an underface with an integral pair of converging lugs disposed towards the underface to secure one end of the compression spring.

5. The carriage member of claim 3, wherein the raised rails are provided with a preformed crimped area adapted to secure the compression spring at its adjacent end.

6. The base member of claim 3, wherein a substantial portion of the opposing flanges bounding the hole has been relieved, thereby facilitating the insertion and removal of a sign card element.

7. A method of assembling the display card holder of claim 1 without the use of tools or fasteners, comprising:

a. Inserting the resilient element in retaining lugs in the carriage member and the latch lever arm, b. compressing the resilient element and offsetting the lever arm laterally, so as to engage the lip of the lever arm adjacent to the head with the adjacent cooperating edge of the carriage member, c. sliding the carriage member, latch lever arm, and compressed resilient element as an assembly in the lower track of the base member, bringing the head in proximate relationship with the opening in the base member, d. sliding the carriage member laterally so as to disengage the cooperative lip of the latch lever arm, whereby the the latch assembly is retained by the lower channel, and the head is resiliently urged through the opening in the base member.

* * * * *